US005141226A

United States Patent [19]

Cavanagh

[11] Patent Number: 5,141,226

[45] Date of Patent: Aug. 25, 1992

[54] BALL RECOVERY SYSTEM

[76] Inventor: Peter A. Cavanagh, 75 W. Greenville Rd., Greenville, R.I. 02828

[21] Appl. No.: 689,254

[22] PCT Filed: Sep. 18, 1990

[86] PCT No.: PCT/US90/05305

§ 371 Date: Jun. 14, 1991

§ 102(e) Date: Jun. 14, 1991

[51] Int. Cl.[5] ..... A63B 61/00

[52] U.S. Cl. ..... 273/29 A; 273/26 A; 273/26 D

[58] Field of Search ..... 273/26 A, 29 A, 29 B, 273/26 R, 26 D, 182 R, 182 A, 29 BC

[56] References Cited

U.S. PATENT DOCUMENTS

| | | | |
|---|---|---|---|
| 1,166,496 | 1/1916 | Toney | 273/181 F |
| 3,215,432 | 11/1965 | Lee et al. | 273/29 A |
| 4,025,071 | 5/1977 | Hodges | 273/29 A |
| 4,073,491 | 2/1978 | Sepanao | 273/29 B |
| 4,204,697 | 5/1980 | Krevzman | 273/29 A |
| 4,456,256 | 6/1984 | Hartland | 273/29 A |
| 4,568,089 | 2/1968 | Scott et al. | 273/29 B |
| 4,575,081 | 3/1986 | Cavanagh | 273/29 A |
| 4,895,366 | 1/1990 | Bartasius | 273/29 B |

*Primary Examiner*—Theatrice Brown
*Attorney, Agent, or Firm*—Barlow & Barlow

[57] ABSTRACT

A tennis ball recovery system utilizes an elastic screen (15) suspended from a back stop at an angle and is joined to a trough that lies on the ground by means that allow the screen (15) to pivot as the trough is moved to a storage position against the back court fence (12). In the operative position the screen is at an angle with respect to the vertical. The trough has a frontal wall (18) that rises at a small angle to the ground and this wall terminates in a lip (22) that lies over the bottom wall (17) of the trough. A feed screw (31,31') fits in the bottom of the trough to feed balls retrieved to a central point where they are discharged into a bucket (42).

19 Claims, 1 Drawing Sheet

BALL RECOVERY SYSTEM

CROSS-REFERENCE TO RELATED APPLICATIONS

This application is related to PCT application No. PCT/US90/05305 which is a continuation-in-part of my application Ser. No. 07/451,642, filed Dec. 18, 1989 (abandoned) which in turn was a continuation-in-part of application Ser. No. 07/307,782 filed Jan. 30, 1989 (U.S. Pat. No. 4,575,081).

BACKGROUND OF THE INVENTION

The present invention relates to a ball returning system for tennis or golf comprising a ball collection assembly which in turn comprises a screen suspended from a vertical structure and a trough connected to the bottom of the screen in which the balls are received. Balls are returned via a conduit connected to the trough, to a ball propulsion device from whence balls are delivered to a player.

In U.S. Pat. No. 4,575,081, there is disclosed a means of retrieving tennis balls which was useful, particularly during instructional sessions or other practice sessions, either with or without a partner. The prior system utilizes a wire fence as the damping screen which would be loosely hung off of a standard back court fence so as to intercept the balls which then would drop onto a resilient apron and thence roll into a collection trough. The major difficulty that has been experienced with this and similar constructions that have vertically oriented damping screens, lies in the fact that the screens either hang loosely or are stretched in a vertical attitude above the trough and it is this screen orientation that causes the balls to sometimes bounce back onto the court. Generally these devices have aprons or wide troughs and, on occasion, the apron does not always operate to restrict the ball's action sufficiently so that all of the balls will land into the trough. Also many of the balls do not hit the damping screen in a uniform pattern and on occasion will drop directly down into the trough which does not sufficiently damp the ball, the balls bouncing out of the apron and onto the court.

Another suggestion in the prior art that utilizes a loose net as a damper for tennis balls that are driven towards it so that the same could fall into some sort of a trough, is seen, for example in the Hodges patent, U.S. Pat. No. 4,025,071. Balls, however, striking a loose net that is not fastened at the bottom edge, tend to deflect the net to a considerable degree and may not always permit the ball to fall into a collection trough thereunder so that at times, even devices of this nature do not operate with total ball recovery. This result is recognized in the Hartland patent, U.S. Pat. No. 4,456,252, which utilizes a sweep rack to insure that the ball falls into the collection trough after they have been stopped by the net.

There have also been some suggestions in the prior art of moving captured balls in troughs by the use of conveyers as, for example, in the Salansky patent, U.S. Pat. No. 4,621,812, where a tennis ball rides solely upon a helical conveyer, the difficulty with this type of construction lies in the fact that the tennis ball can readily be dislodged from the conveyer. A similar arrangement of a conveyer is seen in a second Salansky published application (PCT WO85/04336-EPO 177,514 of Apr. 3, 1985), where a net is held in tension along its upper and lower edges by a spring loaded frame and the net is attached at the lower edge to a support which in turn supports a ramp with a trough that contains a helical screw means for moving the balls.

SUMMARY OF THE INVENTION

The present invention discloses apparatus that recovers tennis or golf shots which have widely differing momentums (i.e. speed and directions) by instrumentalities that change the momentum of the tennis or golf balls so that the balls have a consistently predictable direction of movement, which enables consistent (up to about 99% or more) recovery.

Specifically in one aspect of the invention, the apparatus includes a containment screen suspended from a vertical back court structure (e.g. fence) at an angle so that an apron is not required and also includes a trough defining a generally horizontal ball return channel having a bottom surface. The screen and its inclination angle provide a unique function the ball maintaining contact with the screen so that the ball tracks on its original vertical trajectory and its return to the trough. The trough has means for attaching the screen to the rear of the channel, which allows the screen to pivot as the trough is moved from its storage position in which the trough contacts the vertical back court structure to its operative position in which the trough is forward of the vertical back court structure. Thus, in the operative position, the screen is at an angle with respect to vertical, so that the top of the screen is further from the playing area than the bottom of the screen. A ball striking the screen is held in contact with the screen from the moment of impact through its ascent upwards and even during the moment that either gravity or the projecting stop causes the ball to travel smoothly downwardly along the screen, in a relatively repeatable trajectory, to the trough. A stop surface on the trough is positioned above the bottom surface or floor of the ball return channel and it is positioned forward of the means for attaching the damping screen a distance less than the full diameter of a tennis ball. This geometry operates on balls presented from the screen so that the balls simultaneously encounter the floor and stop surface. This geometry does not permit the balls to be deflected upwardly (over the stop) by the bottom surface of the ball return trough. Thus, according to the invention, balls thus presented from the screen are reliably trapped in the trough.

In preferred embodiments of this aspect of the invention, the stop surface is the free rear edge of an inclined front wall of the trough. The front of the trough thus presents a very slight incline, allowing recovery of rolling balls presented from the court that would not otherwise be accepted into the trough. Even slowly rolling balls can travel over the wall which is inclined at an angle of between 5° and 50° (most preferably 10°–40°). Moreover, the inclined wall is short (preferably less than six inches in length) so that it permits easy storage and does not present a hazard to players on the court.

Additional space economy is provided by the use of a flexible screw conveyor which rests on the front of the bottom wall surface of the channel, below the inclined front wall. A vertical wall runs between the inclined wall and the bottom wall, to support the free edge of the inclined wall, and the flexible conveyor is positioned at the juncture of the bottom wall and the vertical wall. When rotated in the proper direction (i.e., if the screw is a right-handed helix, it is rotated counterclockwise), the conveyor screw cams against the two walls so that it is held in a position that will not interfere with balls entering the channel. Most preferably the flexible conveyor screw is supported only at the motor end, so that it is easy to install and disassemble.

In preferred embodiments, the containment screen comprises elastic netting having a lower edge of sheet material that is fixed to the bottom wall of the trough. The front wall of the trough is inclined toward the screen and has a stop surface that terminates at a height at least one-third the diameter of a tennis ball. The damping screen includes an upper marginal edge binding with a loose layer overlying the screen so that balls moving up the screen are prevented from climbing over the top edge of the screen. Also preferably, the bottom wall of the trough is provided with a groove and the screen is affixed to the trough by a cooperative fastener that fits into the groove; for example, the screen includes an extended cylindrical elongated strip formed by a rope sewn within the sheet material which engages the groove.

In another aspect, the invention generally features tennis ball recovery apparatus having a polyester coated fibre screen that is suspended by shock cords for additional resilience and then extends downwardly at a small angle off the vertical and which has affixed to the lower edge thereof a sheet material that is somewhat flexible but yet exhibits a certain stiffness as for example, a vinyl, or heavy fabric. This terminal portion is then affixed to a wall of the trough which has one wall with a capture lip thereon. Within the trough a helical feed screw is fitted to feed the balls to a central location. The essential action of the flexible elastic screen is to dampen and contain the ball in contact with the screen as it strikes and throughout the ball's descent to the trough. Further, the angle of the screen combined with the topspin on the ball, allows the ball to creep up the screen and then, after the ball has lost its momentum, it falls by gravity, continually tracking the screen, down into the trough to be stopped by a lip on the remote wall of the trough from the screen.

The screen is fitted with an integral projection at its top and side edges so that as some of the balls creep up the screen, should they have sufficient momentum to reach the top or the side due to particular spin action or trajectory, they will be stopped because they will be trapped by the projecting stop and completely lose their momentum rather than going off the net completely.

In order that the invention may be more readily understood and further features thereof appreciated, embodiments of apparatus constructed in accordance with the invention will now be described, by way of example, with reference to the accompanying drawings, in which.

The tennis court has a flat rectangular surface 10 and in the case of a full court, will have a net stretched midway thereof. In the illustrative case, fencing about the court is illustrated, there being a back fence 12 supported on the plurality of posts 14. The back fence of a tennis court is commonly made from a wire known as chain link and conveniently, in combination with the post 14, provides a mounting point for the damping screen of the instant invention.

Figure 2:
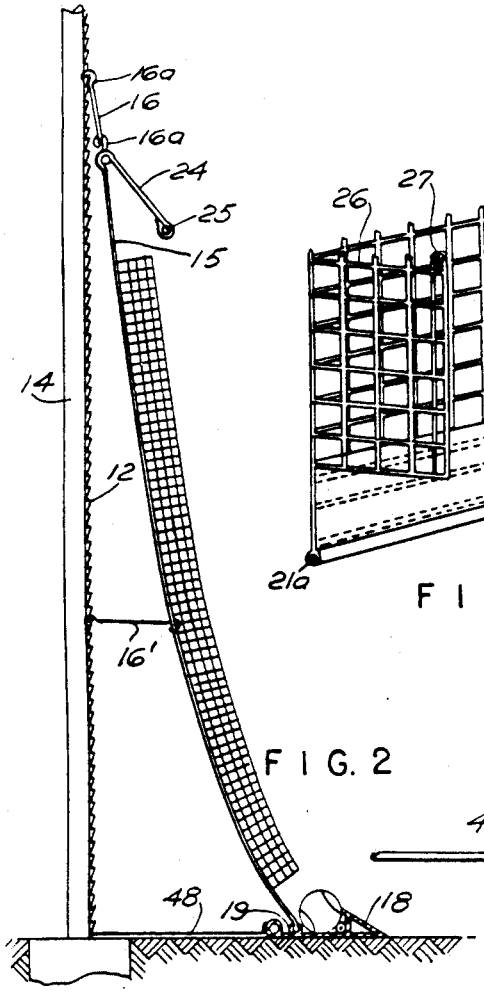
FIG. 2 is a side elevational view illustrating the screen and the trough in position and pulled out from the backstop.

The containment screen 15 of the instant invention may be constructed of any suitable commercially available screening. For example, the screen 15 may be formed of twine which is virtually identical to the net which one might use for fishing or as the conventional tennis net at the center of the court. To this end, there are a plurality of rectangular openings which are smaller than the tennis ball and this netting, which exhibits some elasticity, will be preferably hung either from the chain link back fence 12 or from a plurality of posts 14 by a number of shock cords 16 that have hooks **16*a* at either end thereof for convenience. Other forms of screening that are satisfactory are a polyester fibre coated with a vinyl and formed into screening that may be as small as 3 mm squares. As seen in FIG. 2 of the drawings, the screen 15 hangs down in a steep angle and is retained in that position by a plurality of shock cords with hooks as seen at 16'. At the bottom edge of the net or screen, there is affixed a stiff but somewhat flexible material 20 such as a canvas that has a rope sewn within 21, the edge thereof forming an attachment hem for the net or screen 15**.

Figure 4:
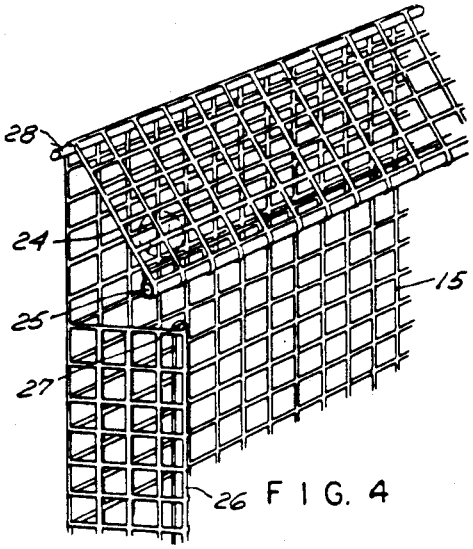
FIG. 4 is a view of a corner of the screen illustrating the projecting stops and the securement of the screen.
Figure 4A:
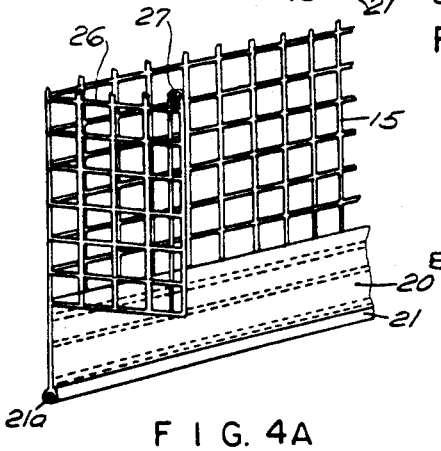
FIG. 4A is a view of the bottom corner of the screen.
Figure 5:
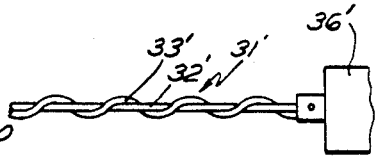
FIG. 5 is a fragmental view of the helix drive cable.

Referring to FIGS. 2, 4 and 4A it will be noted that a projecting stop 24 is provided at the top edge of the screen 15 and to add rigidity to the stop that is in the form of an edge binding or flap, a rod 25 is inserted into the edge thereof. Similarly vertical edge stops 26 are provided also having rods 27 in the terminal edges thereof. Desirably the stops are portions of the screen that have been folded over a hem or terminal portion and are conveniently manufactured in this state. Alternately, the vertical edge stops may be rigid plastic that has been formed into a U-shape and suitably attached to the edge of the screen. As seen in FIG. 4, the top edge of the screen has an upper fastener bar 28 that provides an excellent attachment point of the hooks of the shock cord 16.

Figure 3:
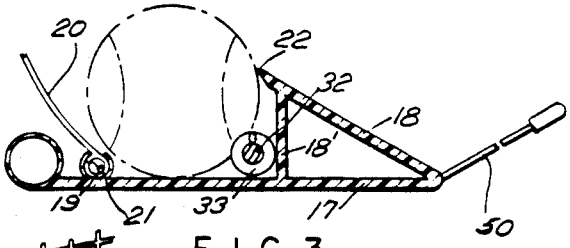
FIG. 3 is an enlarged view showing the trough with the ball retained therein in phantom.

Referring to FIG. 3, the trough has a bottom wall surface formed from a base plate 17 and an angular or inclined front wall 18 that is held in position by a vertical portion 18'. Spaced from the front wall substantially the diameter of a tennis ball, is a C shaped clip 19 to which the fabric portion 20 with rope **21*a* sewn within hem 21 forming a cylindrical edge that engages clip 19. The upper edge 22 of the front wall 18** forms a front stop surface and is located substantially at or above the diameter of a regulation tennis ball which insures retention of the ball in the trough.

The trough of FIG. 3 has a dimension between the edge 22 and the clip 19 just slightly less than the nominal diameter of a tennis ball. In addition, the tennis ball is retained in the trough by virtue of the fact that the rotation of the helical drive, the detailed description of which appears below, is such that the tennis ball is nominally forced against the clip 19 and to this end, as will be noted, there are two drives towards the center, each driven by a separate motor so as to achieve the desired result.

Figure 3A:
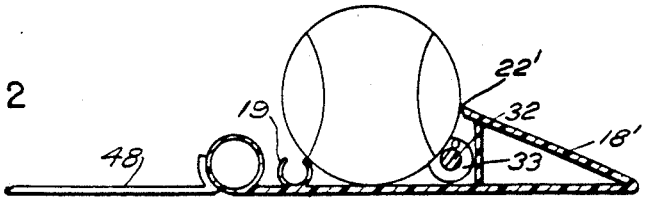
FIG. 3A is a view of a modified cross section of trough.

The trough of FIG. 3A illustrates the retention of a tennis ball with the stop surface edge 22' located below the diameter of the ball, or great circle thereof stated in geometrical terms. This arrangement is made possible by the fact that the helical screw mechanism 31 forces the ball toward the clip 19.

Figure 1:
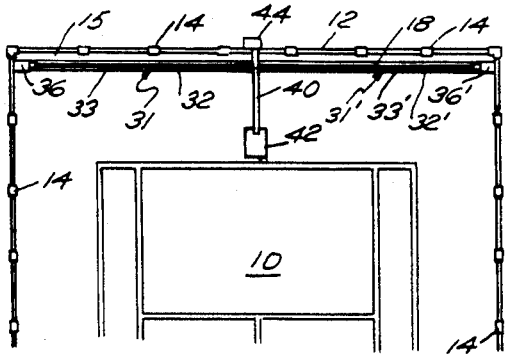
FIG. 1 is a plan view of a portion of a tennis court showing the placement of the invention relative thereto.

A helical drive mechanism 31, 31' is located within the trough and consists essentially of a pair of central cables 32, 32' which have wound around the periphery thereof a cord 33 for example. As seen in FIG. 1, these cables may be conveniently driven by some form of a motors 36, 36' which have output shafts connected to the cables 32, 32'. In this fashion, as a ball drops into the trough, the cable, which is located in the V of the trough will be driven towards a portion thereof, for example centrally, from whence the balls may be then directed via a conduit 40 into a catch basket of a ball serving machine 42 as seen in FIG. 1, by the utilization of an air blower 44. The conduit 40 for convenience may be made telescopic. Essentially therefore, the air blower acts as a pressurizing means that drives the balls through the tube and the tube can therefore be considered pneumatically operated. Normally, the trough has sufficient mass to be retained in position ahead of the back court fence of a tennis court. To insure the position a pair of bars 48 are provided. The trough is readily moveable rearwardly to the backstop and for this purpose a rod 50 with a handle is supplied. In this fashion, a normal tennis game may proceed without any further modifications, something that is not possible with the devices that are known in the prior art. There is, therefore, a rather decided advantage to this particular arrangement since mere removal of the ball throwing machine and the conduit together with moving the screen or net structure rearward are all that are necessary.

One of the particular features of the invention is the design of the trough. In the FIG. 3 configuration the trough has a substantial horizontal portion that serves as an anchor for the netting while the front wall 18 has a slope that permits balls that may be rolling on the ground to roll up the incline and into the trough. Also the front wall extends beyond the vertical portion 18' thereof so that a lip is formed substantially at or just above the center of a normal tennis ball to keep the ball in the trough. The balls are also kept in the trough by the fact that the fabric portion 20 is clipped in at 19 and contacts the periphery of the ball as a flexible web urging the ball against the lip, see FIG. 3.

The troughs are conveniently made in sections to facilitate storage and shipment. As seen in FIG. 2, the provision of the C shape clip allows sliding of the trough from the attachment hem 21. For movement, the telescopic tube 40 is collapsed and the ball serving machine 42 is removed. Then by providing a simple rod 50 with a handle that engages the trough as seen in FIG. 3, it may be moved against the backstop of the court to give full usage of the back court.

In operation, a ball striking the screen moves upward staying in contact with the screen through the moment that either gravity or the projecting stop overcomes its upward movement. Since the screen is angled outward, the ball will travel smoothly downward along the screen to the trough. Upon striking the trough bottom wall 17, the ball will also simultaneously strike the stop lip 22 and be retained by the screen fabric portion 20 that is elastic. The geometry is such that the balls are not deflected upward over the stop lip by striking the trough bottom wall or floor.

I claim:

1. A ball practice system for use on a sport playing surface having vertical support structure, said recovery system comprising:

a. a screen having top, bottom and side edges;

b. means attaching the top of said screen to said vertical structure to thereby suspend said screen therefrom; and c. a trough defining a generally horizontally ball return channel having a rear wall, a bottom wall surface having a rear edge and a front wall member having a free top edge, said rear wall being defined by said screen, said bottom wall having attachment means for attaching said screen thereto, said front wall member having a stop surface positioned above said bottom surface, said stop surface being positioned forward of said attachment means a predetermined distance, said predetermined distance being such that a ball rolling from the screen and into said through simultaneously strikes said stop surface and the bottom well, said attachment means allowing said screen to pivot when said trough is moved from a storage position in which it contacts said vertical support structure, to an operative position forward of said vertical structure so that said screen is at an angle with respect to vertical, the top of said screen being further from the playing area than the bottom of said screen;

whereby the momentum of a ball striking said screen and the inclination of said screen will cause said ball to be held in contact with the screen at the moment of impact and have upward movement until gravity causes the ball to roll down the screen and into said return channel.

2. The system of claim 1 in which said front wall member is inclined toward said screen the top edge of which is free and comprises said stop surface.

3. The system of claim 2 in which said trough has a vertical wall between said front wall means and said bottom wall to support the free top edge of said front wall member.

4. The system of claim 3 in which said trough is fitted with a flexible screw conveyor and said conveyor is located at the juncture of the bottom and vertical walls and is rotated in a direction to cam the conveyor against said walls.

5. The system of claim 4 in which said flexible screw conveyor is supported only at the end of the trough.

6. The system of claim 1 in which said screen comprises elastic netting.

7. The system of claim 6 in which said attachment means includes sheet material connecting said elastic netting to said trough.

8. The system of claim 1 further comprising means to manually move the trough between said storage position and said operative position.

9. The system of claim 8 further comprising a tube connected between said trough and a ball serving machine, and air pressurizing means to drive balls from said trough through said tube and to said ball serving machine.

10. The system of claim 9 in which said tube is connected to a central location of said trough.

11. In a tennis recovery system for a tennis playing court surface having a vertical back court support structure extending above said court surface, an inclined elastic netting screen having a top horizontal edge attached to said support above said court surface and a bottom edge positioned at said court surface, means defining a bottom wall supported on said court surface, said bottom wall having front and rear edges, said screen bottom edge being attached adjacent said rear edge of said bottom wall, a front wall, said front wall being inclined towards said screen and having a free top edge and a lower edge attached to said front edge of said bottom wall, said screen, bottom wall and front wall defining a trough, said trough being spaced from said support means to thereby place said screen in an inclined orientation relative to said court surface such that a ball impacting said screen will roll down said screen and into said trough, said trough having a conduit attached thereto for conveying balls from said trough to a remote ball receptacle.

12. The system of claim 2 or claim 11 in which said front inclined wall is inclined at an angle of between 5° and 50° with respect to vertical.

13. The system of claim 2 or claim 11 in which said front inclined wall is less than six inches in height.

14. The system of claim 6 or claim 11 in which a plurality of shock cords are provided and the elastic netting is supported by the plurality attached to the top edge of the netting and to the back court structure.

15. The system of claim 2 or claim 11 wherein the top edge of the inclined wall is at a height greater than one-half the diameter of a regulation tennis ball.

16. The system of claim 3 or claim 11 wherein the top edge of the inclined wall is at a height equal to or slightly less than the diameter of a regulation tennis ball.

17. The system of claim 1 or claim 11 in which the screen has an upper marginal edge binding with a projecting stop overlying the screen whereby balls moving up the screen are prevented from climbing over the top edge of the screen.

18. The system of claim 1 or claim 11 wherein the bottom wall of the trough has a groove and the screen is affixed to the trough at said bottom edge by engaging said groove so that the trough may be readily disconnected therefrom.

19. The system of claim 18 wherein the bottom edge of the screen is provided with a flexible fabric of predetermined width, said fabric being reinforced by rope to form a cylindrical edge that engages said groove.

* * * * *